US010076887B2

(12) United States Patent
Aganovic et al.

(10) Patent No.: US 10,076,887 B2
(45) Date of Patent: Sep. 18, 2018

(54) METHODS AND APPARATUS FOR FORMING AND SEALING A CONTAINER HAVING CENTERING TABS

(71) Applicant: WestRock Shared Services LLC, Norcross, GA (US)

(72) Inventors: Amer Aganovic, Orlando, FL (US); Thomas Dean Graham, Orlando, FL (US)

(73) Assignee: WestRock Shared Services, LLC, Atlanta, GA (US)

( * ) Notice: Subject to any disclaimer, the term of this patent is extended or adjusted under 35 U.S.C. 154(b) by 792 days.

(21) Appl. No.: 13/826,914

(22) Filed: Mar. 14, 2013

(65) Prior Publication Data

US 2014/0113789 A1 Apr. 24, 2014

Related U.S. Application Data

(60) Provisional application No. 61/716,258, filed on Oct. 19, 2012.

(51) Int. Cl.

| | |
|---|---|
| ***B31B 1/26*** | (2006.01) |
| ***B31B 3/00*** | (2006.01) |
| ***B65D 21/02*** | (2006.01) |
| ***B65D 5/00*** | (2006.01) |
| ***B65D 5/02*** | (2006.01) |
| *B31B 50/02* | (2017.01) |
| *B31B 50/36* | (2017.01) |
| *B31B 50/54* | (2017.01) |
| *B31B 50/00* | (2017.01) |

(52) U.S. Cl.

CPC ..... *B31B 3/00* (2013.01); *B65D 5/001* (2013.01); *B65D 5/0227* (2013.01); *B65D 21/023* (2013.01); *B31B 50/0044* (2017.08); *B31B 50/0045* (2017.08); *B31B 50/02* (2017.08); *B31B 50/36* (2017.08); *B31B 50/54* (2017.08)

(58) Field of Classification Search

CPC ..... B31B 3/00; B31B 1/00; B31B 2201/02; B31B 2201/2637; B31B 2201/2675; B31B 2201/295; B31B 2201/297; B65D 5/001; B65D 5/0227; B65D 21/023

USPC ..... 493/162

See application file for complete search history.

(56) References Cited

U.S. PATENT DOCUMENTS

| | | | |
|---|---|---|---|
| 1,101,479 | A | 6/1914 | Van Osdel |
| 1,901,530 | A | 3/1933 | Pellymounter |
| 2,652,970 | A | 9/1953 | George |
| 2,719,664 | A | 10/1955 | Hester |
| 2,744,675 | A | 5/1956 | Crane |
| 2,894,672 | A | 7/1959 | Bamburg |
| 2,965,279 | A | 12/1960 | Campbell |
| 3,006,523 | A | 10/1961 | Keith |
| 3,017,064 | A | 1/1962 | Davis |
| 3,047,157 | A | 7/1962 | Bergman |
| 3,103,278 | A | 9/1963 | Kuzma et al. |

(Continued)

*Primary Examiner* — Sameh Tawfik

(74) *Attorney, Agent, or Firm* — WestRock IP Legal

(57) ABSTRACT

A machine for forming and sealing a top of a container is provided. The machine includes a conveyor configured to transport the container through the machine, a forming section including at least one bullet arm configured to fold a trailing centering tab of the container, and a compression section downstream from the forming section and including a compression device configured to fold a leading centering tab of the container.

10 Claims, 22 Drawing Sheets

(56) References Cited

U.S. PATENT DOCUMENTS 3,114,495 A 12/1963 Grooms
3,473,690 A 10/1969 De Cazenove
3,572,577 A 3/1971 Dorfman
3,644,008 A 2/1972 Overby
3,744,707 A 7/1973 Ross
3,820,706 A 6/1974 Gibson et al.
3,937,390 A 2/1976 Winkler
3,971,300 A 7/1976 Bachner
4,161,907 A * 7/1979 Ganz ..... B31B 3/00 493/135
4,215,525 A * 8/1980 Nigrelli ..... B65B 5/068 53/207
4,244,472 A 1/1981 Brown
4,245,773 A 1/1981 Stollberg
4,261,503 A 4/1981 Lawrence et al.
4,356,952 A 11/1982 Rekow
4,383,636 A 5/1983 Chaffers
4,529,088 A 7/1985 Quong
4,537,344 A 8/1985 Thomas
4,660,725 A 4/1987 Fishman et al.
4,709,852 A 12/1987 Stoll
5,039,005 A * 8/1991 Flaming ..... B65D 5/001 229/125.39
5,054,262 A * 10/1991 Hertel ..... B31B 1/00 206/446
5,662,508 A * 9/1997 Smith ..... A63H 33/04 229/127
5,782,732 A * 7/1998 Herrin ..... B31B 1/36 493/131
6,234,385 B1 5/2001 Espinoza et al.
6,247,593 B1 6/2001 Ruble
6,257,411 B1 * 7/2001 Bacques ..... B65D 5/001 206/508
6,427,907 B1 8/2002 Espinoza et al.
6,935,504 B2 8/2005 Ritter et al.
7,717,838 B2 * 5/2010 Strong ..... B31B 1/44 493/126
8,011,564 B2 9/2011 Garner
8,647,247 B2 * 2/2014 Pazdernik ..... B31B 1/00 493/175
8,827,142 B2 * 9/2014 Smith ..... B31B 1/36 206/509
9,022,913 B2 * 5/2015 Graham ..... B31B 1/28 493/462
2010/0044423 A1 * 2/2010 Graham ..... B65D 5/445 229/185.1
2011/0036749 A1 2/2011 Jacobsson et al.
2011/0281705 A1 * 11/2011 Aganovic ..... B31B 3/00 493/89

* cited by examiner

METHODS AND APPARATUS FOR FORMING AND SEALING A CONTAINER HAVING CENTERING TABS

CROSS REFERENCE TO RELATED APPLICATIONS

This application claims priority to U.S. Provisional Application No. 61/716,258 filed Oct. 19, 2012, which is hereby incorporated by reference in its entirety.

BACKGROUND OF THE INVENTION

This invention relates generally to containers formed from sheet material, and more specifically to forming and sealing a top of a container that includes at least one centering tab.

Containers fabricated from paperboard and/or corrugated paperboard material are often used to store and transport goods. These containers can include four-sided containers, six-sided containers, eight-sided containers, bulk bins and/or various size corrugated barrels. Such containers are usually formed from blanks that are folded along a plurality of preformed fold lines to form an erected corrugated container.

These containers may be stacked atop one another for storage, transport, and/or display purposes. However, if the containers are not properly aligned when stacked, the stack of containers may be unstable, may collapse, and/or may occupy additional space. Some known container centering systems have been used in the past to attempt to stack containers in an aligned column. However, such known systems have proven to be fragile and do not withstand repeated manipulation.

Accordingly, there is a need for a container that facilitates relatively easy and efficient stacking, as well as machines for manufacturing such containers from associated blanks.

BRIEF DESCRIPTION OF THE INVENTION

In one aspect, a machine for forming and sealing a top of a container is provided. The machine includes a conveyor configured to transport the container through the machine, a forming section including at least one bullet arm configured to fold a trailing centering tab of the container, and a compression section downstream from the forming section and including a compression device configured to fold a leading centering tab of the container.

In another aspect, a method for forming and sealing a top of a container is provided. The method includes transporting the container through a machine along a conveyor, folding at least one trailing centering tab using at least one bullet arm, folding at least one leading centering tab using a compression conveyor to form the top of the container, and compressing the formed top of the container with the compression device to seal the formed top of the container.

DETAILED DESCRIPTION OF THE INVENTION

The embodiments described herein provide a stackable, reinforced container formed from a single sheet of material and a method for constructing and sealing the container. The container is sometimes referred to as a retail ready package (RRP) or a wrap-style box as sheet material may be wrapped around the product or a mandrel to form the container. The container may be constructed from a blank of sheet material using at least one machine. Thus the container could be any style of box having top flaps and centering tabs.

In one embodiment, the blanks are fabricated from a cardboard material. The blanks, however, may be fabricated using any suitable material, and therefore are not limited to a specific type of material. In alternative embodiments, the blanks are fabricated using cardboard, plastic, fiberboard, paperboard, foamboard, corrugated paper, and/or any suitable material known to those skilled in the art and guided by the teachings herein provided. The container may have any suitable size, shape, and/or configuration, whether such sizes, shapes, and/or configurations are described and/or illustrated herein. Further, different embodiments described here can vary in size and/or dimensions.

In an example embodiment, the container includes at least one marking thereon including, without limitation, indicia that communicates the product stored in the tray, a manufacturer of the product, and/or a seller of the product. For example, the marking may include printed text that indicates a product's name and briefly describes the product, logos and/or trademarks that indicate a manufacturer and/or seller of the product, and/or designs and/or ornamentation that attract attention. "Printing," "printed," and/or any other form of "print" as used herein may include, but is not limited to including, ink jet printing, laser printing, screen printing, giclee, pen and ink, painting, offset lithography, flexography, relief print, rotogravure, dye transfer, and/or any suitable printing technique known to those skilled in the art and guided by the teachings herein provided. In another embodiment, the container is void of markings, such as, without limitation, indicia that communicates the product, a manufacturer of the product and/or a seller of the product.

The following detailed description illustrates the disclosure by way of example and not by way of limitation. The description clearly enables one skilled in the art to make and use an exemplary container, describes several embodiments, adaptations, variations, alternatives, and use of the blanks and/or containers, including what is presently believed to be the best mode of carrying out the disclosure.

Figure 1:
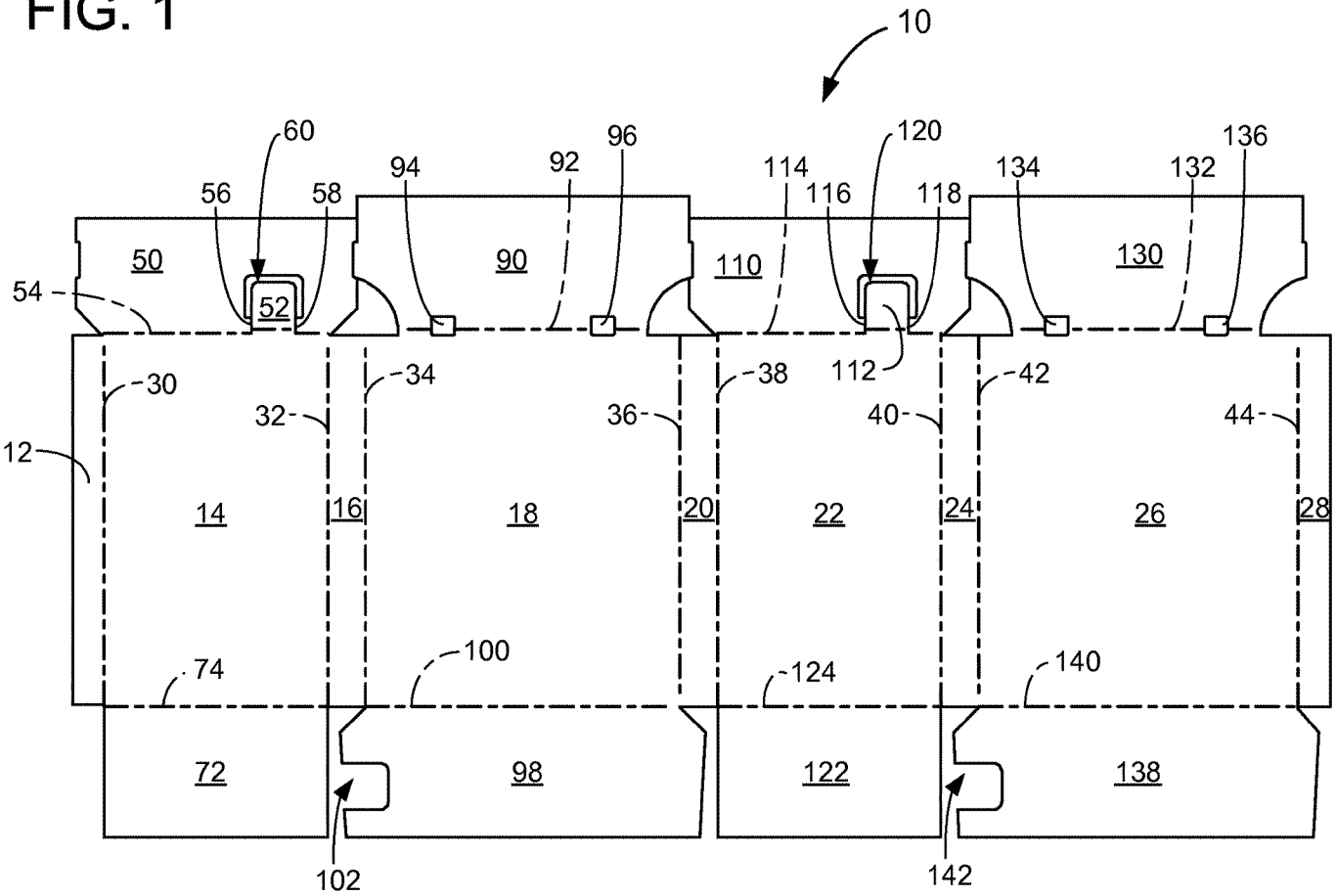
FIG. 1 is a top plan view of an exemplary embodiment of a blank of sheet material.

FIG. 1 illustrates a top plan view of an exemplary embodiment of a substantially flat blank 10 of sheet material. As shown in FIG. 1, the blank 10 includes a succession of aligned wall panels and end panels connected together by a plurality of preformed, generally parallel, fold lines. The aligned panels include a succession of nine panels 12, 14, 16, 18, 20, 22, 24, 26, 28 connected together by a plurality of preformed, generally parallel, fold lines 30, 32, 34, 36, 38, 40, 42, and 44, respectively. Specifically, the nine wall panels include a first end panel 12, a front panel 14, a first intermediate panel 16, a first side panel 18, a second intermediate panel 20, a back panel 22, a third intermediate panel 24, a second side panel 26, and a second end panel 28. The front panel 14 extends from the first end panel 12 along fold line 30, the first intermediate panel 16 extends from the front panel 14 along fold line 32, the first side panel 18 extends from the first intermediate panel 16 along fold line 34, the second intermediate panel 20 extends from the first side panel 18 along fold line 36, the back panel 22 extends from the second intermediate panel 20 along fold line 38, the third intermediate panel 24 extends from the back panel 22 along fold line 40, the second side panel 26 extends from the third intermediate panel 24 along fold line 42, and the second end panel 28 extends from the second side panel 26 along fold line 44.

The front panel 14 includes a first minor flap 50 and a first centering tab 52 extending therefrom along a fold line 54. The portion of fold line 54 between first minor flap 50 and the front panel 14 is offset with respect to the portion of fold line 54 between first centering tab 52 and the front panel 14. The first centering tab 52 is separated from first minor flap 50 by a first cut line 56, a second cut line 58, and a first u-shaped cutout 60, such that first centering tab 52 and first minor flap 50 are capable of being folded independent from one another about fold line 54. The front panel 14 also includes a first bottom flap 72 extending therefrom along a fold line 74.

The first side panel 18 includes a first major flap 90 extending therefrom along a fold line 92. The first major flap includes a first cutout 94 and a second cutout 96 at fold line 92. The first side panel 18 also includes a second bottom flap 98 extending therefrom along a fold line 100. The second bottom flap 98 includes a first notch 102 that has substantially the same dimensions as first centering tab 52.

The back panel 22 includes a second minor flap 110 and a second centering tab 112 extending therefrom along a fold line 114. The portion of fold line 114 between second minor flap 110 and the back panel 22 is offset with respect to the portion of fold line 114 between second centering tab 112 and the back panel 22. The second centering tab 112 is separated from second minor flap 110 by a third cut line 116, a fourth cut line 118, and a second u-shaped cutout 120, such that second centering tab 112 and second minor flap 110 are capable of being folded independent from one another about fold line 114. The back panel 22 also includes a third bottom flap 122 extending therefrom along a fold line 124.

The second side panel 26 includes a second major flap 130 extending therefrom along a fold line 132. The second major flap 130 includes a third cutout 134 and a fourth cutout 136 at fold line 132. The second side panel 26 also includes a fourth bottom flap 138 extending therefrom along a fold line 140. The fourth bottom flap 138 includes a second notch 142 that has substantially the same dimensions as first and second centering tabs 52 and 112.

As will be described in more detail below, the shape, size, and arrangement of centering tabs 52 and 112 and notches 102 and 142 as shown in FIG. 1 and described above facilitates stacking a plurality of containers each formed from blank 10.

Figure 2:
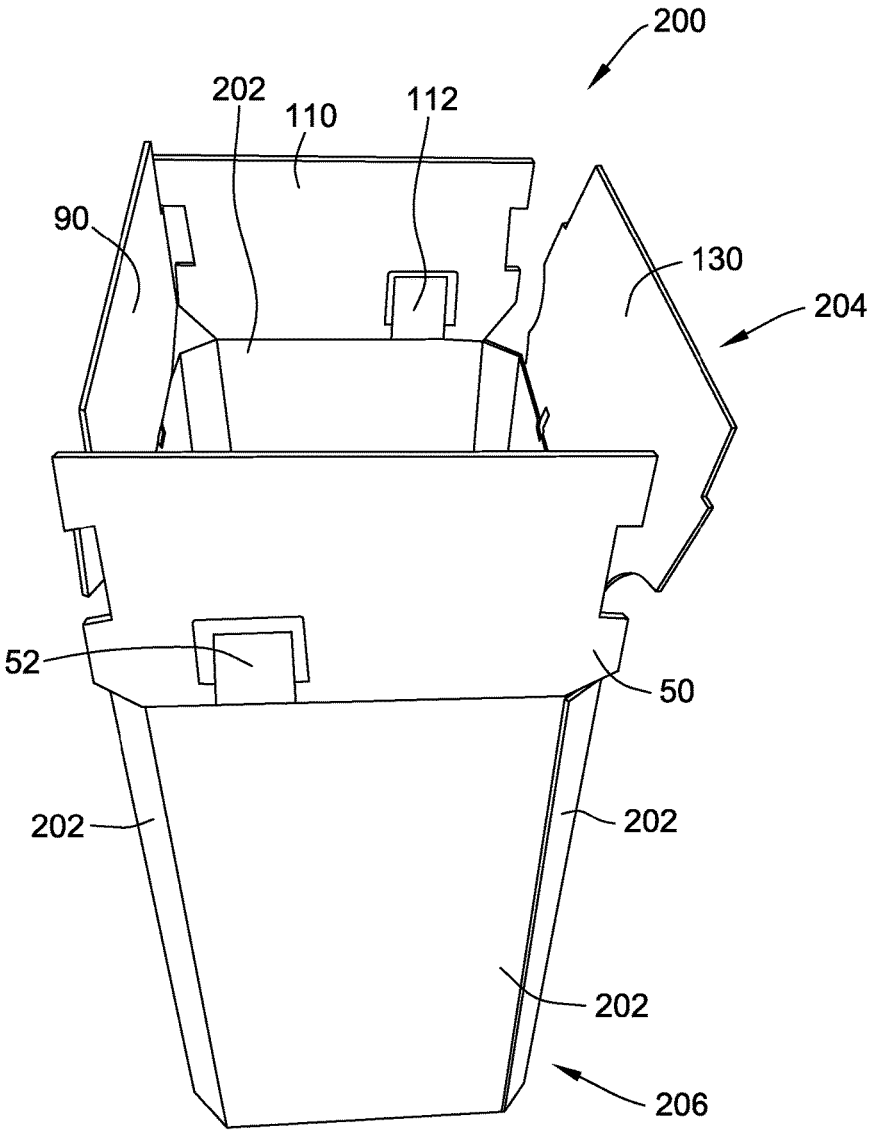
FIG. 2 is perspective view of an exemplary embodiment of a container in a partially open state that may be formed from the blank shown in FIG. 1.
Figure 3:
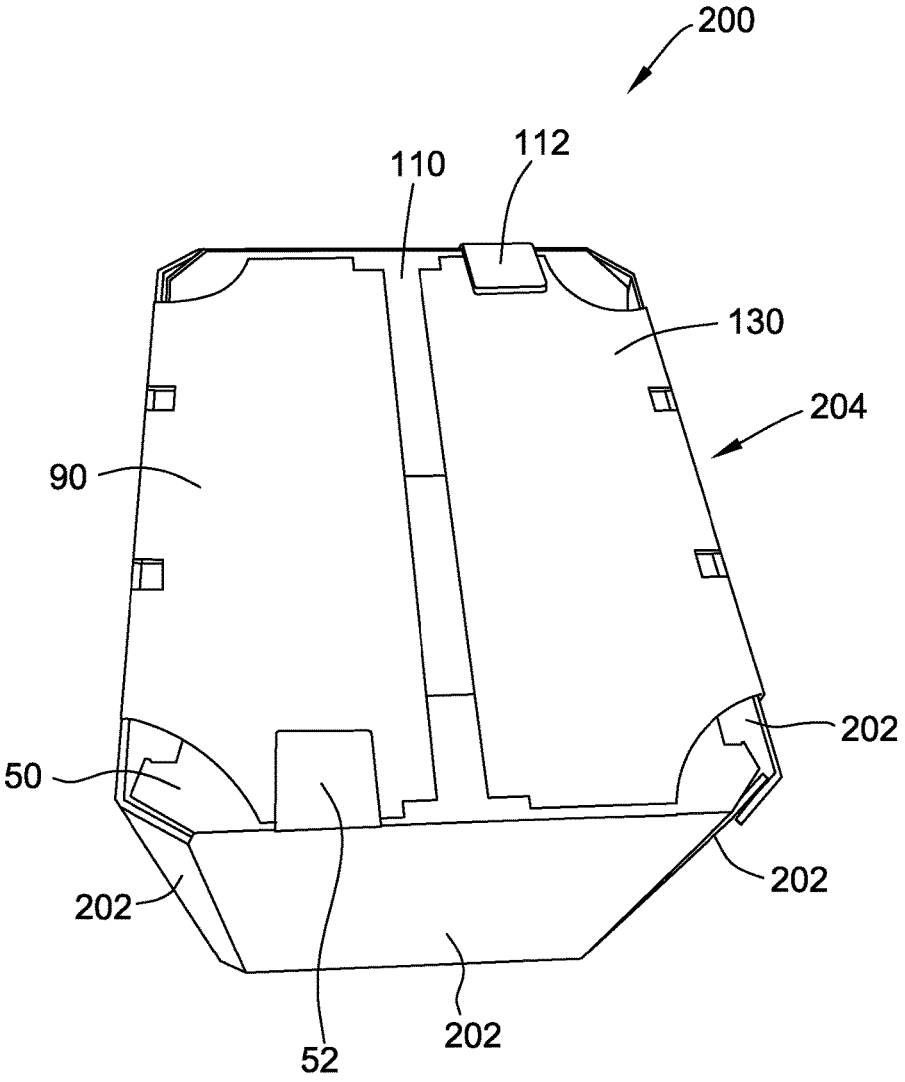
FIG. 3 is a perspective view of the container shown in FIG. 2 in a closed state.

FIGS. 2 and 3 are perspective views of an exemplary embodiment of a container 200 that may be formed from blank 10 (shown in FIG. 1). The container 200 includes eight side walls 202, a top 204, and a bottom 206. In FIG. 2, the top 204 is in an open state and the bottom 206 is in a closed state. In FIG. 3, the top 204 and bottom 206 are in a closed state.

The container 200 is formed by folding blank 10 along fold lines. Specifically, side walls 202 of container 200 are formed by folding wall panels 12, 14, 16, 18, 20, 22, 24, 26, 28 along fold lines 30, 32, 34, 36, 38, 40, 42, and 44. In formed container 200, second end panel 28 overlaps and is adhered to first end panel 12 using an adhesive, such as glue. In the exemplary embodiment, side walls 202 are formed by folding wall panels 12, 14, 16, 18, 20, 22, 24, 26, 28 around a mandrel (not shown).

To form the top 204 of container 200, minor flaps 50 and 110 are folded inward (i.e., towards the cavity of the container 200) about fold lines 54 and 114, respectively, such that minor flaps 50 and 110 are substantially perpendicular to front panel 14 and back panel 22. Once minor flaps 50 and 110 are folded inward, major flaps 90 and 130 are folded inward about fold lines 92 and 132, respectively, such that major flaps 90 and 130 are substantially perpendicular to first side panel 18 and second side panel 26. Once major flaps 90 and 130 are folded inward, centering tabs 52 and 112 are folded inward on top of major flaps 90 and 130, respectively, about fold lines 54 and 114, respectively. Accordingly, in closed top 204, minor flaps 50 and 110 are folded beneath/inside of major flaps 90 and 130, which are in turn folded beneath/inside of centering tabs 52 and 112. Adhesive is applied to one or more of minor flaps 50 and 110, major flaps 54 and 114, and centering tabs 52 and 112 to facilitate maintaining the top 204 in a closed state. In the exemplary embodiment, the top 204 of container 200 is formed using a sealing machine, as described in detail below.

To form the bottom 206 of container 200, the first bottom flap 72 and the third bottom flap 122 are folded inward about fold lines 74 and 124, respectively, such that bottom flaps 72 and 122 are substantially perpendicular to front panel 14 and back panel 22. Once bottom flaps 72 and 122 are folded inward, the second bottom flap 98 and the fourth bottom flap 138 are folded inward about fold lines 100 and 140, respectively, such that bottom flaps 98 and 138 are substantially perpendicular to side panels 18 and 26. Accordingly, for closed bottom 206, bottom flaps 72 and 122 are folded above/inside of bottom flaps 98 and 138. Adhesive is applied to one or more of bottom flaps 72, 98, 122, 138 to facilitate maintaining the bottom 206 in a closed state.

Figure 4:
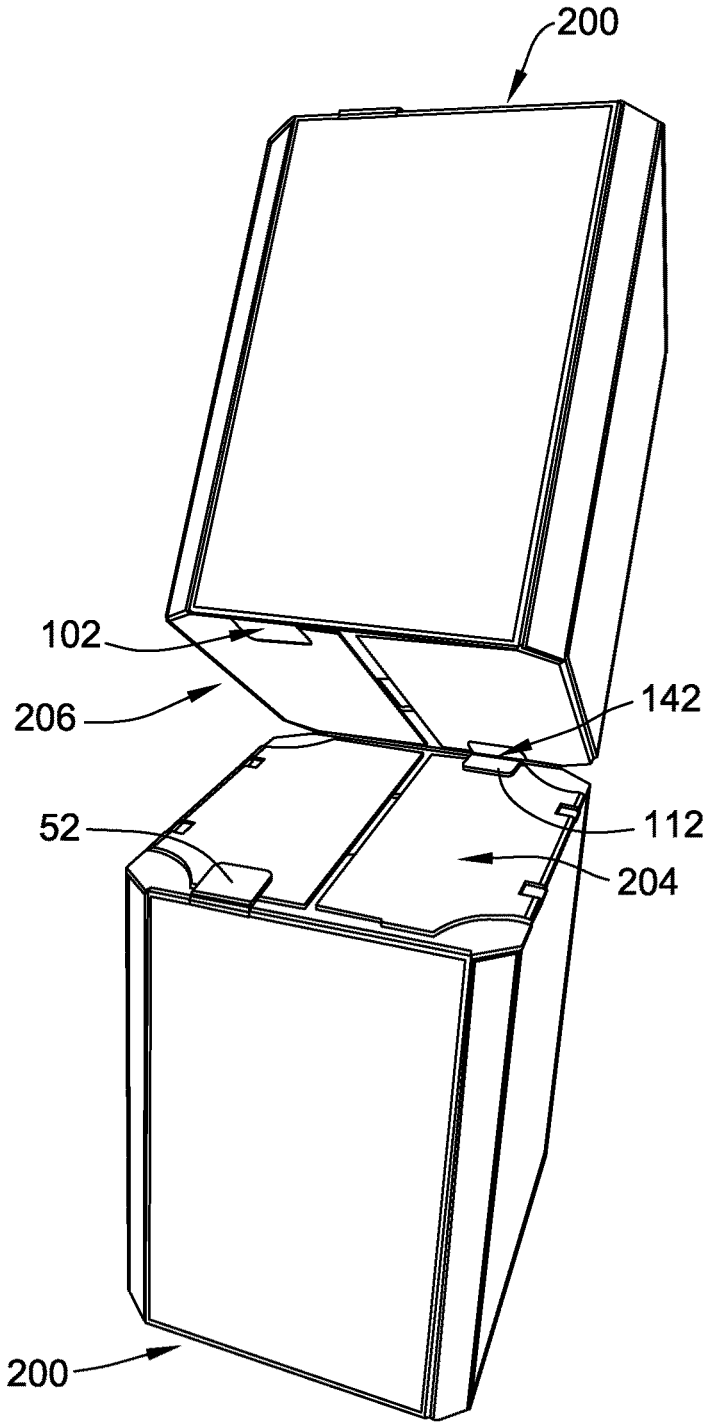
FIG. 4 is a perspective view of two of the containers shown in FIG. 2 in a partially stacked state.
Figure 5:
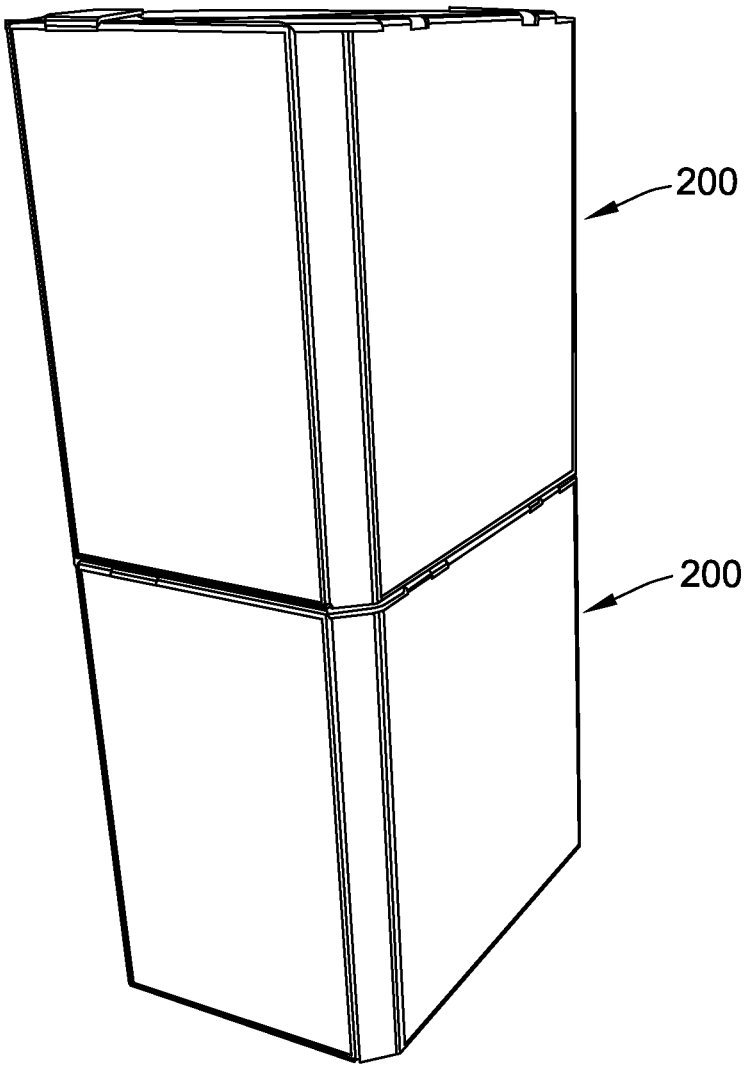
FIG. 5 is a perspective view of two of the containers shown in FIG. 2 in a stacked state.

FIGS. 4 and 5 are perspective views of two containers 200 in a partially stacked state and a stacked state, respectively. As shown in FIG. 4, centering tabs 52 and 112 on the top 204 of one container 200 nest in notches 102 and 142, respectively, on the bottom 206 of the other container 200. Accordingly, centering tabs 52 and 112 ensure that containers 200 are aligned with one another when stacked atop one another, as shown in FIG. 5.

Figure 6:
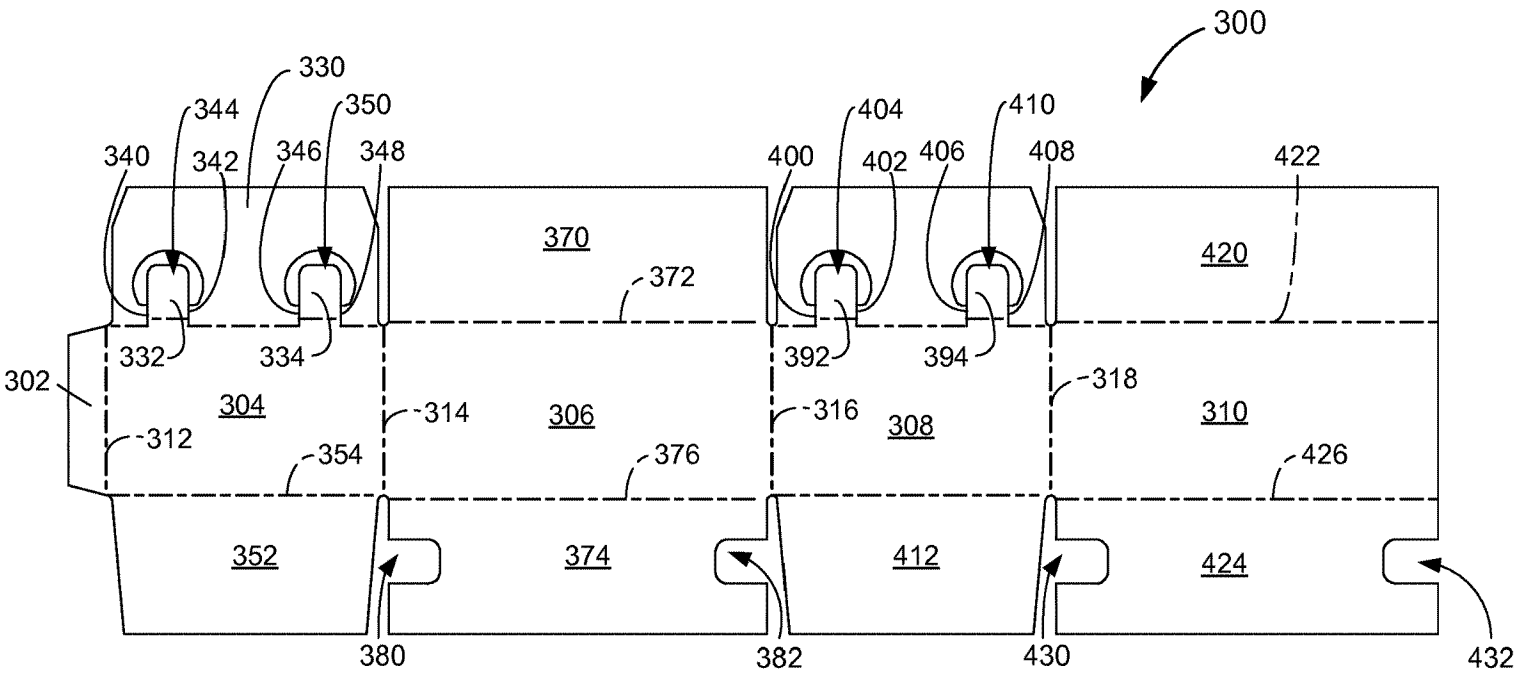
FIG. 6 is a top plan view of an alternative exemplary embodiment of a blank of sheet material.

FIG. 6 illustrates a top plan view of an alternative exemplary embodiment of a substantially flat blank 300 of sheet material. As shown in FIG. 6, the blank 300 includes a succession of aligned wall panels and end panel connected together by a plurality of preformed, generally parallel, fold lines. The aligned panels include a succession of five panels 302, 304, 306, 308, 310 connected together by a plurality of preformed, generally parallel, fold lines 312, 314, 316, and 318, respectively. Specifically, the five wall panels include an end panel 302, a front panel 304, a first side panel 306, a back panel 308, and a second side panel 310. The front panel 304 extends from the end panel 302 along fold line 312, the first side panel 306 extends from the front panel 304 along fold line 314, the back panel 308 extends from the first side panel 306 along fold line 316, and the second side panel 310 extends from the back panel 308 along fold line 318.

The front panel 304 includes a first minor flap 330, a first centering tab 332, and a second centering tab 334 extending therefrom along a fold line 336. The portion of fold line 336 between first minor flap 330 and the front panel 304 is offset with respect to portions of fold line 336 between first and second centering tabs 332 and 334 and the front panel 304. The first centering tab 332 is separated from first minor flap 330 by a first cut line 340, a second cut line 342, and a first u-shaped cutout 344, and the second centering tab 334 is separated from first minor flap 330 by a third cut line 346, a fourth cut line 348, and a second u-shaped cutout 350, such that centering tabs 332 and 334 and first minor flap 330 are capable of being folded independent from each other about fold line 336. The front panel 304 also includes a first bottom flap 352 extending therefrom along a fold line 354.

The first side panel 306 includes a first major flap 370 extending therefrom along a fold line 372. The first side panel 306 also includes a second bottom flap 374 extending therefrom along a fold line 376. The second bottom flap 374 includes a first notch 380 and a second notch 382 that have substantially the same dimensions as centering tabs 332 and 334.

The back panel 308 includes a second minor flap 390, a third centering tab 392, and a fourth centering tab 394 extending therefrom along a fold line 396. The portion of fold line 396 between second minor flap 390 and the back panel 308 is offset with respect to portions of fold line 396 between third and fourth centering tabs 392 and 394 and the back panel 308. The third centering tab 392 is separated from the second minor flap 390 by a fifth cut line 400, a sixth cut line 402, and a third u-shaped cutout 404, and the fourth centering tab 394 is separated from second minor flap 390 by a seventh cut line 406, an eighth cut line 408, and a fourth u-shaped cutout 410, such that centering tabs 392 and 394 and second minor flap 390 are capable of being folded independent from each other about fold line 396. The back panel 308 also includes a third bottom flap 412 extending therefrom along a fold line 414.

The second side panel 310 includes a second major flap 420 extending therefrom along a fold line 422. The second side panel 310 also includes a fourth bottom flap 424 extending therefrom along a fold line 426. The fourth bottom flap 424 includes a first notch 430 and a second notch 432 that have substantially the same dimensions as centering tabs 332, 334, 392, and 394.

As will be described in more detail below, the shape, size, and arrangement of centering tabs 332, 334, 392, and 394 and notches 380, 382, 430, and 432 as shown in FIG. 6 and described above facilitates stacking a plurality of containers each formed from blank 300.

Figure 7:
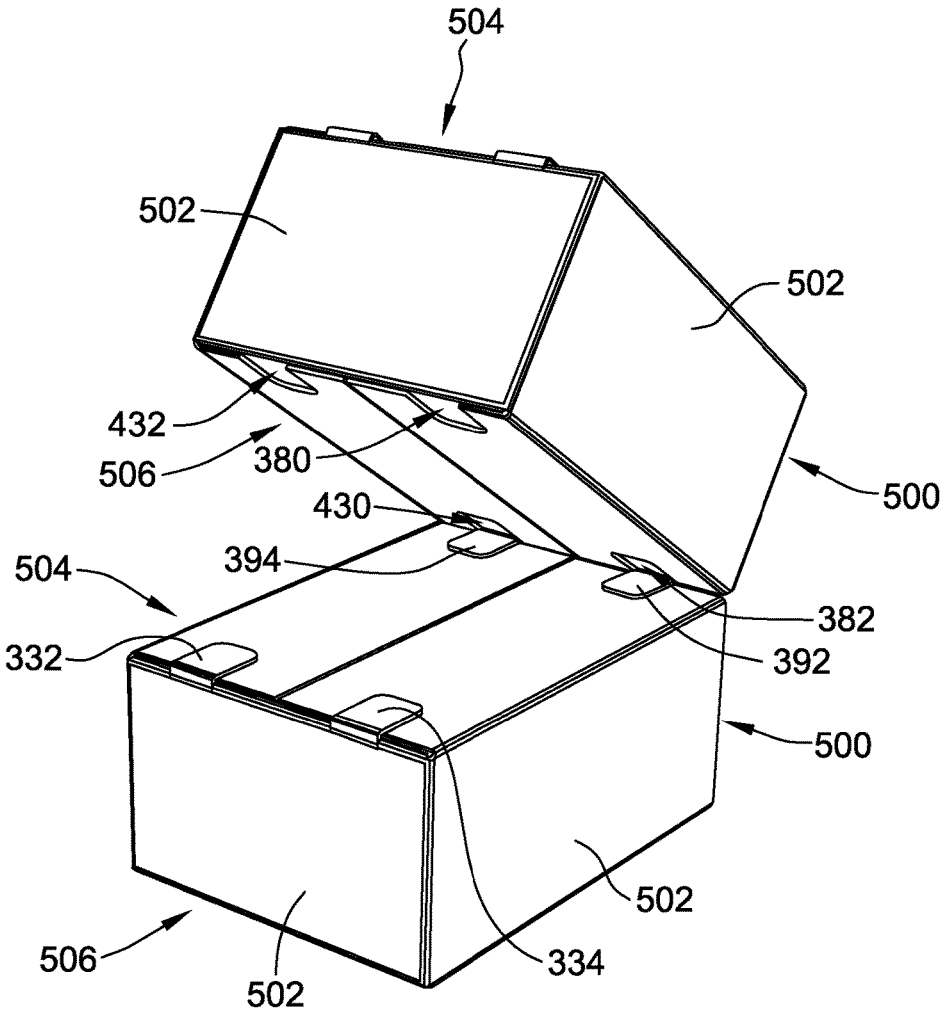
FIG. 7 is a perspective view of two containers formed from the blank shown in FIG. 6 in a partially stacked state.
Figure 8:
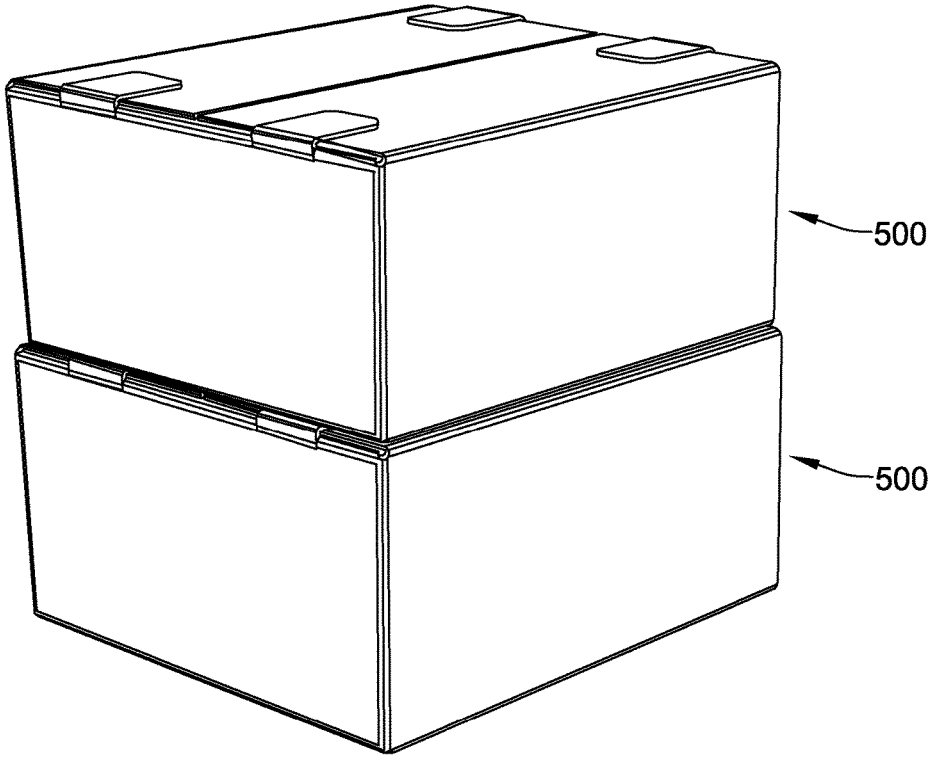
FIG. 8 is a perspective view of two containers formed from the blank shown in FIG. 6 in a stacked state.

FIGS. 7 and 8 are perspective views of two containers 500 each formed from blank 300 (shown in FIG. 6) in a partially stacked state and a stacked state, respectively. Each container 500 includes four sidewalls 502, a top 504, and a bottom 506. Each container 500 is formed by folding blank 300 along fold lines. Specifically, side walls 502 of container 200 are formed by folding wall panels 302, 304, 306, 308, and 310 along fold lines 312, 314, 316, and 318. In formed container 500, end panel 302 overlaps and is adhered to second side panel 310 using an adhesive, such as glue. In the exemplary embodiment, side walls 502 are formed by folding wall panels 302, 304, 306, 308, and 310 around a mandrel (not shown).

To form the top 504 of container 500, minor flaps 330 and 390 are folded inward about fold lines 336 and 396, respectively, such that minor flaps 330 and 390 are substantially perpendicular to front panel 304 and back panel 308. Once minor flaps 330 and 390 are folded inward, major flaps 370 and 420 are folded inward about fold lines 372 and 422, respectively, such that major flaps 370 and 420 are substantially perpendicular to first side panel 306 and second side panel 310. Once major flaps 370 and 420 are folded inward, centering tabs 332, 334, 392, and 394 are folded inward on top of major flaps 370 and 420 about fold lines 336 and 422, respectively. Accordingly, in closed top 504, minor flaps 330 and 390 are folded beneath/inside of major flaps 370 and 420, which are in turn folded beneath/inside of centering tabs 332, 334, 392, and 394. Adhesive is applied to one or more of minor flaps 330 and 390, major flaps 370 and 420, and centering tabs 332, 334, 392, and 394 to facilitate maintaining the top 504 in a closed state. In the exemplary embodiment, the top 504 of container 500 is formed using a sealing machine, as described in detail below.

To form the bottom 506 of container 500, the first bottom flap 352 and the third bottom flap 412 are folded inward about fold lines 354 and 414, respectively, such that bottom flaps 352 and 412 are substantially perpendicular to front panel 304 and back panel 308. Once bottom flaps 352 and 412 are folded inward, the second bottom flap 374 and the fourth bottom flap 424 are folded inward about fold lines 376 and 426, respectively, such that bottom flaps 374 and 424 are substantially perpendicular to side panels 306 and 310. Accordingly, for closed bottom 506, bottom flaps 352 and 412 are folded above/inside of bottom flaps 374 and 424. Adhesive is applied to one or more of bottom flaps 352, 374, 412, and 424 to facilitate maintaining the bottom 506 in a closed state.

As shown in FIG. 7, centering tabs 332, 334, 392, and 394 on the top 504 of one container 500 nest in notches 380, 382, 430, and 432 on the bottom 506 of the other container 500. Accordingly, centering tabs 332, 334, 392, and 394 ensure that containers 500 are aligned with one another when stacked atop one another, as shown in FIG. 8.

The blank 10 shown in FIG. 1 includes two centering tabs (i.e., the first centering tab 52 extending from the front panel 14 and the second centering tab 112 extending from the back panel 22). The blank 300 shown in FIG. 6 includes four centering tabs (i.e., the first and second centering tabs 332 and 334 extending from the front panel 304, and the third and fourth centering tabs 392 and 394 extending from back panel 308). However, blanks 10 and 300 are not limited to the number of centering tabs illustrated in FIGS. 1 and 6, and may include any suitable number of centering tabs.

Figure 9:
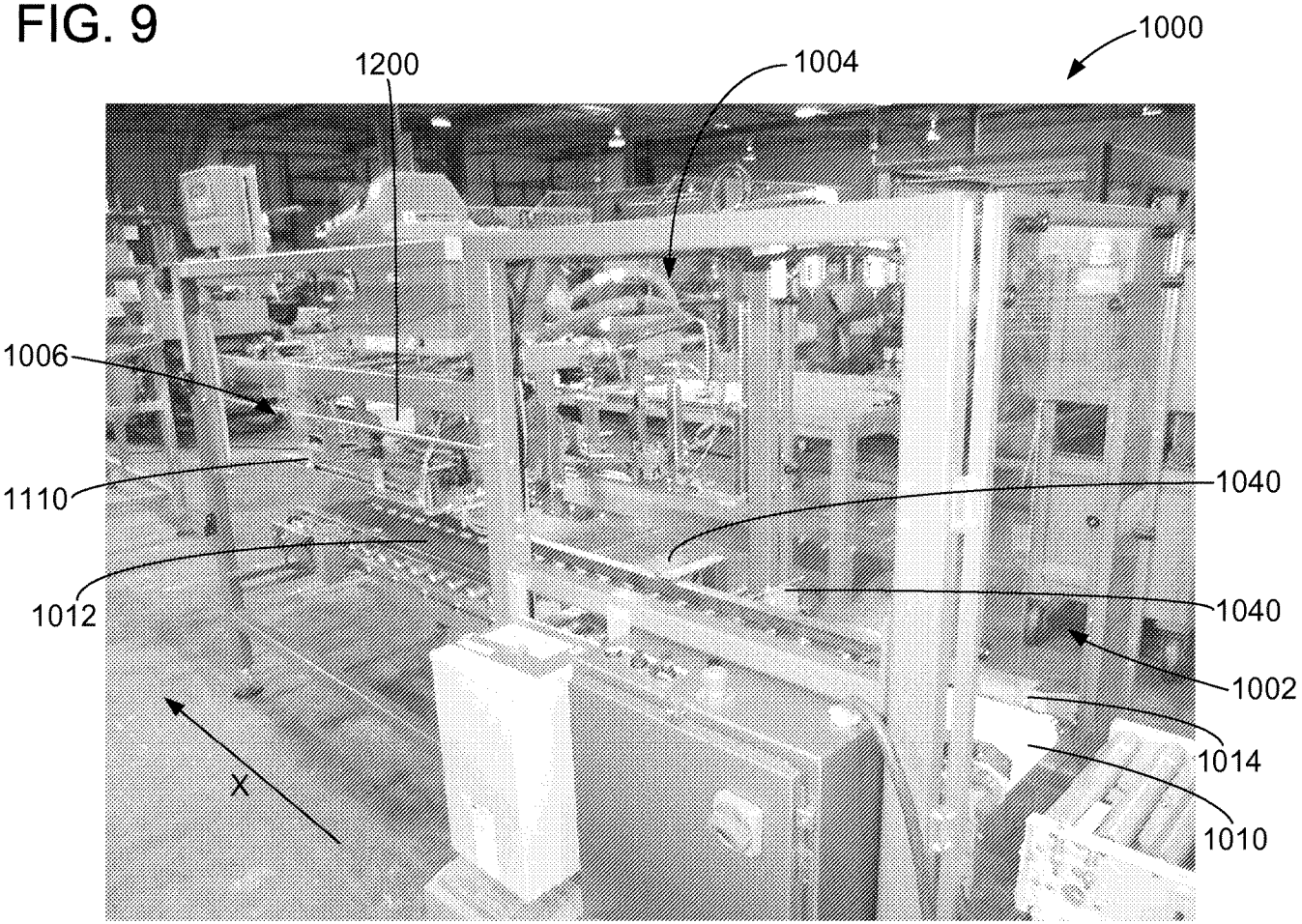
FIG. 9 is a perspective view of an exemplary machine for forming and sealing a container.

FIG. 9 illustrates a perspective view of an exemplary machine (generally designated by 1000) for forming and sealing a container (e.g., the containers shown in FIGS. 2-5, 7, and 8). More specifically, machine 1000 forms and seals the top of a container, such as top 204 of container 200 and top 504 of container 500, as described in detail below. The machine 1000 will be discussed hereafter with reference to sealing the container 200 formed from blank 10. However, the machine 1000 may be used to seal the container 500 formed from blank 300, and/or any container having any size, shape, or configuration from a blank having any size, shape, or configuration without departing from the scope of the present invention.

As shown in FIG. 9, machine 1000 includes a loading section 1002, a forming section 1004, and a compression section 1006. The loading section 1002 section is positioned in the front of the machine 1000 with respect to a loading direction X. Forming section 1004 is positioned downstream from loading section 1002, and compression section 1006 is positioned downstream from forming section 1004.

Loading section 1002 includes a first conveyor 1010 and a second conveyor 1012 downstream from first conveyor 1010. Conveyors 1010 and 1012 transport container 200 through machine 1000 along loading direction X. Second conveyor 1012 extends from loading section 1002 through forming section 1004 and compression section 1006. In the exemplary embodiment, first conveyor 1010 transports container 200 at a first speed and second conveyor 1012 transports container 200 at a second speed that is greater than the first speed. When multiple containers 200 are transported through machine 1000, the difference in speeds between first conveyor 1010 and second conveyor 1012 creates a gap, or delay, between two consecutive containers 200. Alternatively, conveyors 1010 and 1012 may operate at the same speed, or machine 1000 may include a single conveyor. A pair of parallel lower guide rails 1014 extend along conveyors 1010 and 1012 to maintain the alignment and orientation of container 200 as it passes through machine 1000, ensuring that front panel 14 and back panel 22 remain substantially perpendicular to the loading direction X.

In the exemplary embodiment, container 200 passes through machine 1000 with front panel 14 oriented to be the leading face of container 200 and back panel 22 oriented to be the trailing face of container 200 with respect to loading direction X. Accordingly, first centering tab 52 is also referred to herein as the leading centering tab 52, second centering tab 112 is also referred to herein as the trailing centering tab 112, first minor flap 50 is also referred to herein as the leading minor flap 50, and second minor flap 110 is also referred to herein as the trailing minor flap 110. Notably, container 200 can also pass through machine 1000 in the reverse orientation (i.e., with back panel 22 as the leading face and front panel 14 as the trailing face).

Figure 10:
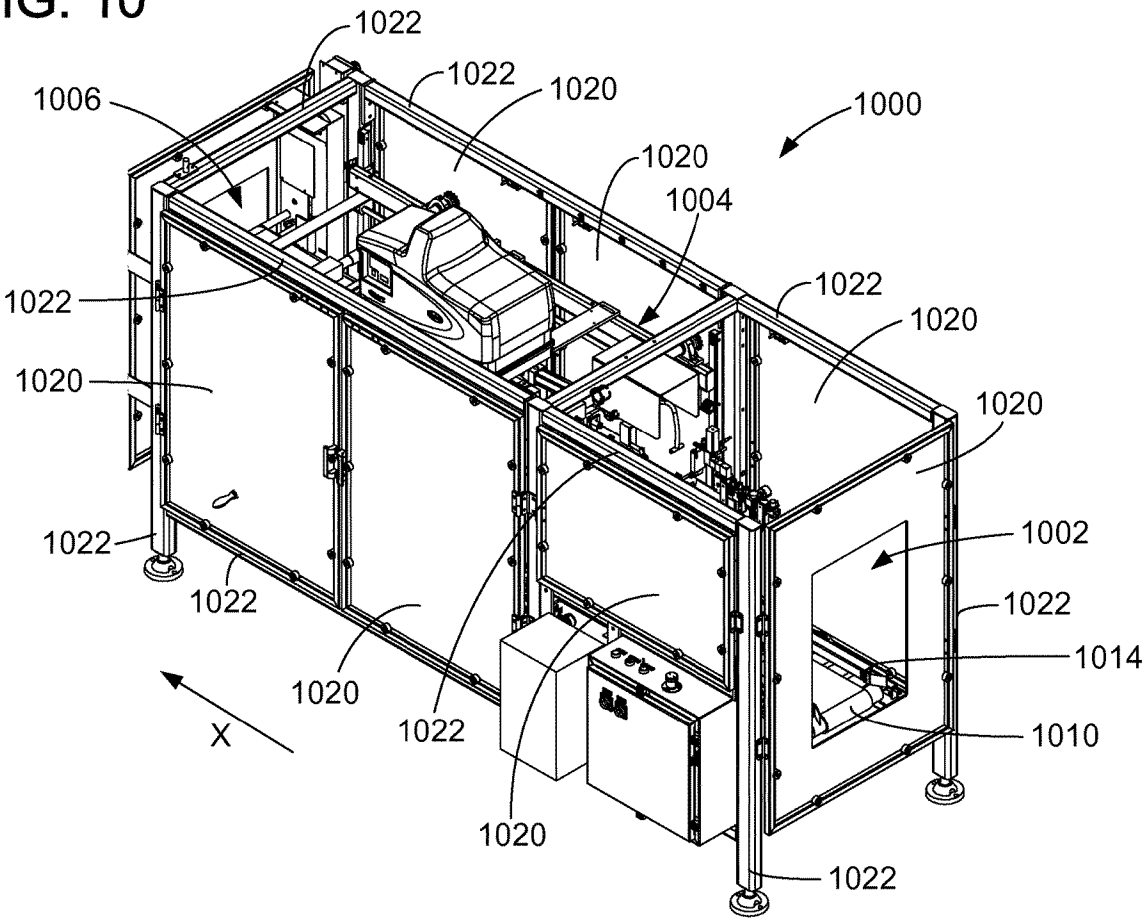
FIG. 10 is a perspective view of the machine shown in FIG. 9.

FIG. 10 is a perspective view of the machine 1000 includes a plurality of protective panels 1020. Protective panels 1020 are coupled to frame members 1022, and prevent external objects from interfering with operation of the machine 1000. Protective panels 1020 may be made of plastic, glass, and/or any suitable material that facilitates protecting components of machine 1000. In the exemplary embodiment, protective panels 1020 are substantially transparent, enabling an operator to visually monitor operation of machine 1000.

Figure 11:
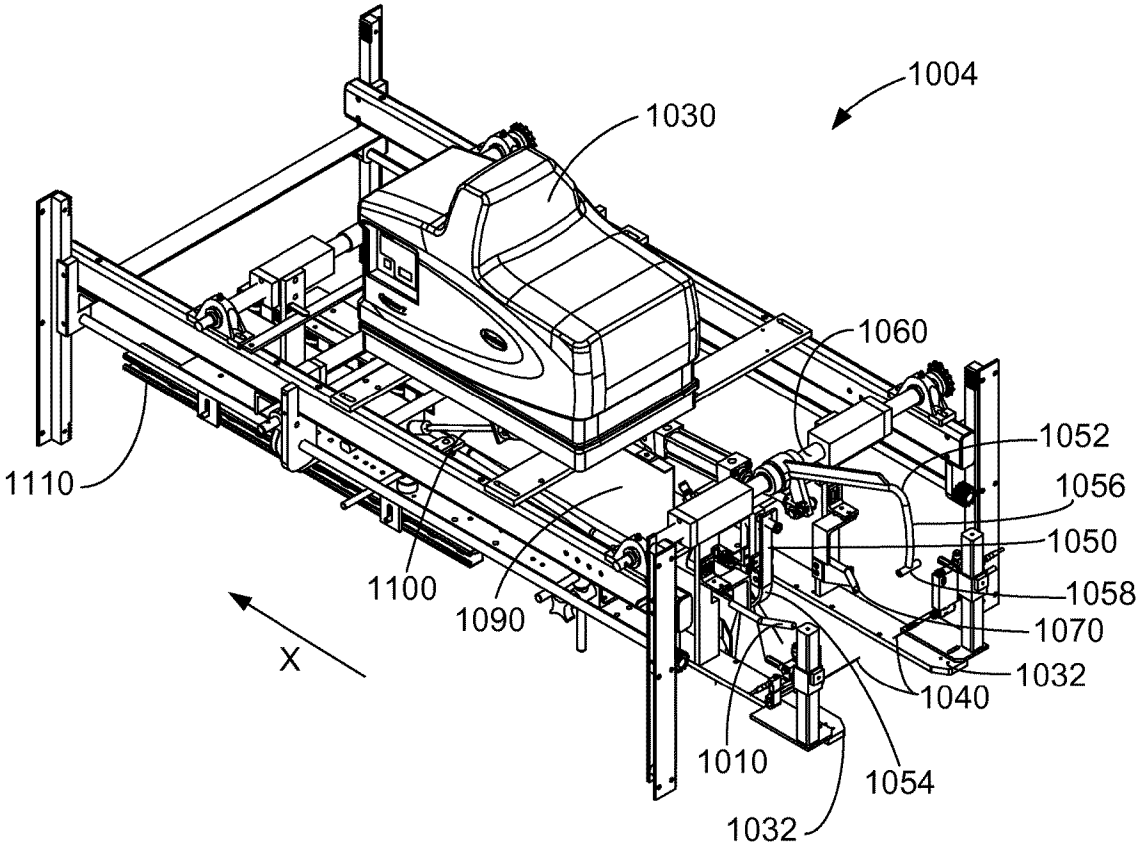
FIG. 11 is a perspective view of a forming section of the machine shown in FIG. 9.
Figure 12:
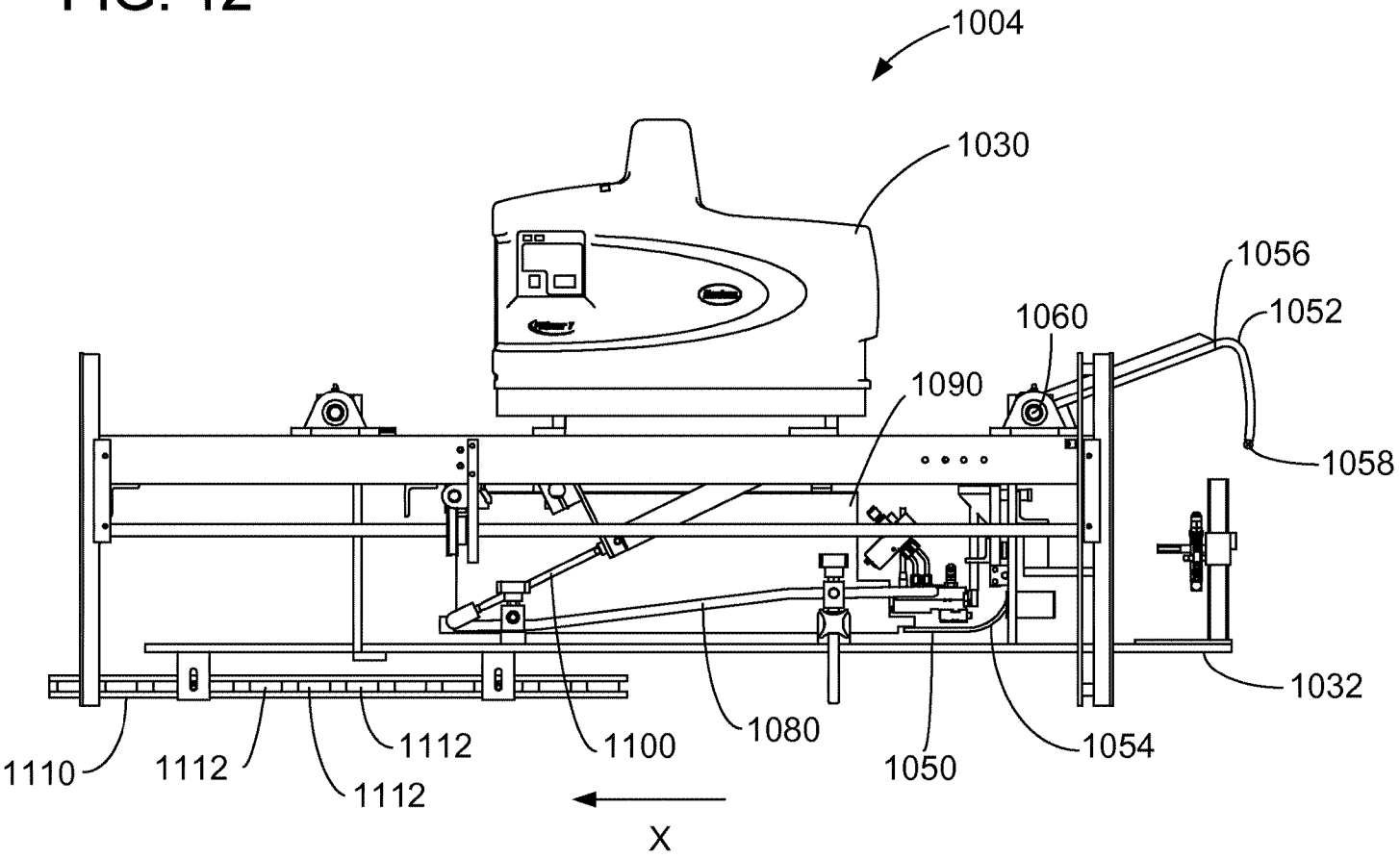
FIG. 12 is a side view of the forming section shown in FIG. 11.
Figure 13:
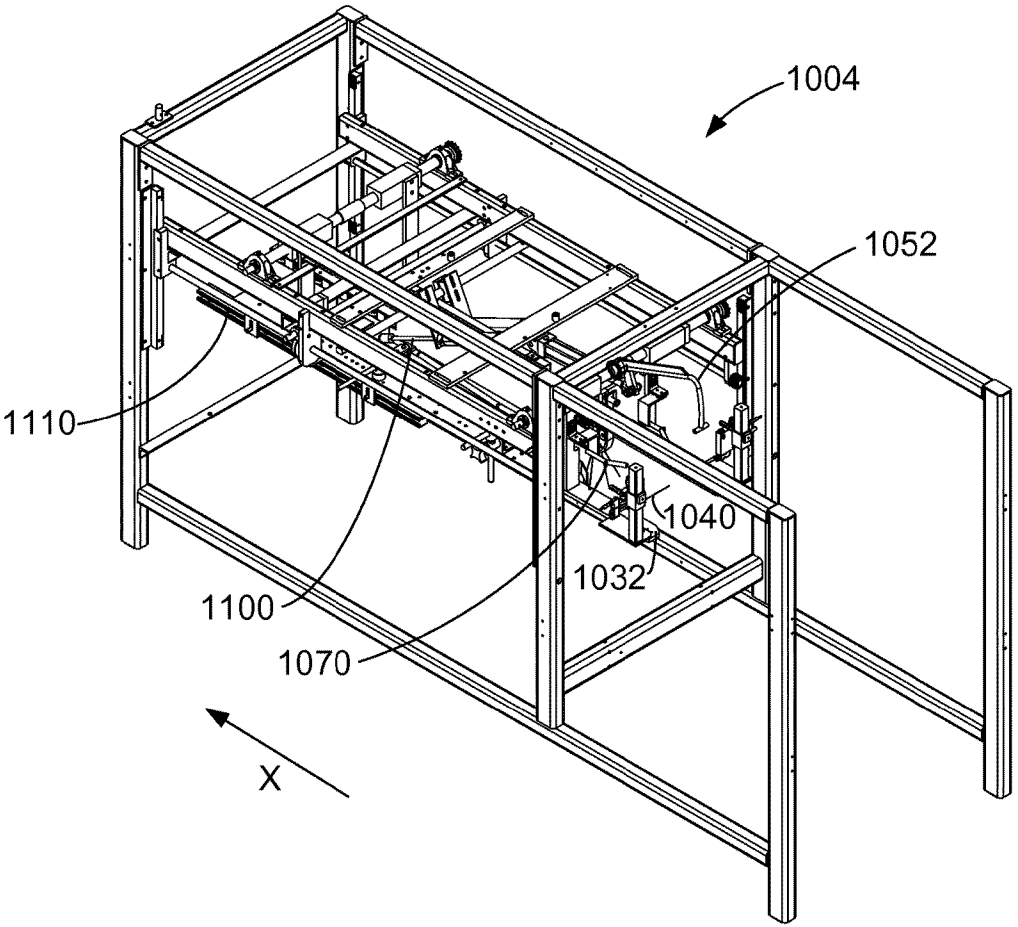
FIG. 13 is a perspective view of the forming section shown in FIG. 11 omitting a control unit.
Figure 14:
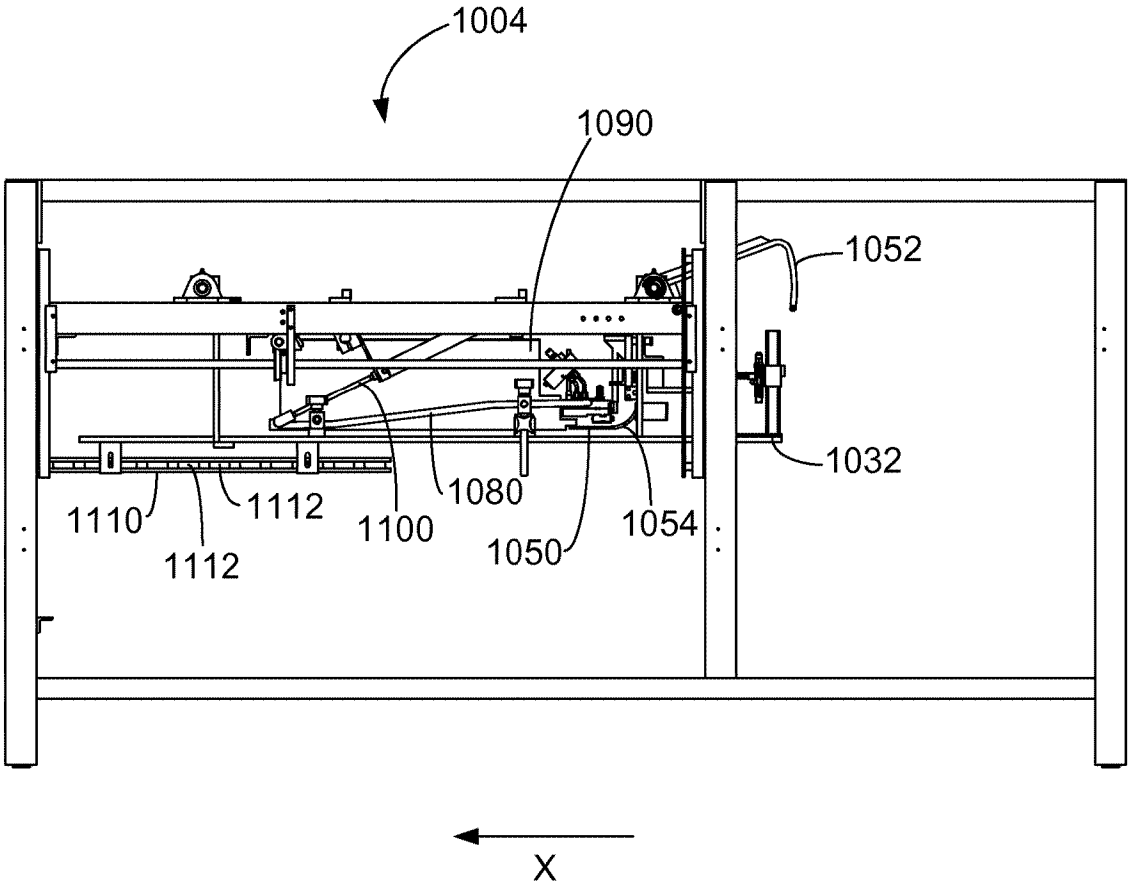
FIG. 14 is a side view of the forming section shown in FIG. 11 omitting a control unit.
Figure 15:
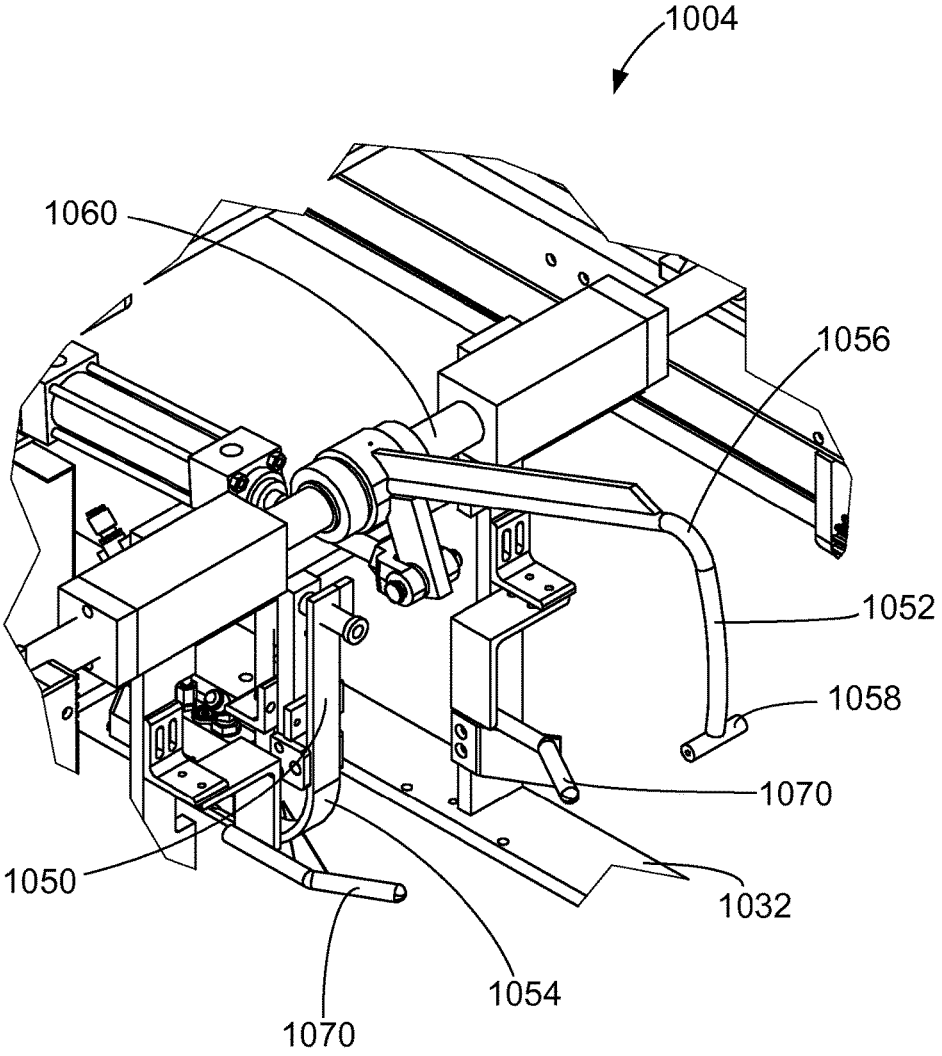
FIG. 15 is an enlarged view of a portion of the forming section shown in FIG. 11.

FIGS. 11-15 illustrate the forming section 1004 of the machine 1000. FIG. 11 is a perspective view of forming section 1004, FIG. 12 is a side view of forming section 1004, FIG. 13 is a perspective view of forming section 1004 omitting a control unit 1030, FIG. 14 is a side view of forming section 1004 omitting the control unit 1030, and FIG. 15 is an enlarged view of a portion of forming section 1004. Control unit 1030 controls the operation of one or more components of machine 1000. One or more components of machine 1000 may be driven using servo motors and/or other suitable driving mechanisms coupled to control unit 1030.

As shown in FIG. 11, forming section includes a set of upper guide rails 1032 that maintain the alignment and orientation of container 200 as it passes through machine 1000, ensuring that front panel 14 and back panel 22 remain substantially perpendicular to the loading direction X.

As container 200 passes through machine 1000, it contacts one or more switches 1040. The switches 1040 trigger operation of one or more components of the machine 1000. That is, when container 200 contacts a switch 1040, one or more components operate (e.g., move, fire, apply adhesive, etc.) a predetermined time after the switch 1040 is contacting. Thus, switches 1040 ensure that the operation of the components of machine 1000 is in sync with the position of the container 200 within the machine 1000. In the exemplary embodiment, each switch 1040 is a pin that rotates when contacted by container 200. Switches may be located, for example, on upper guide rails 1032 and lower guide rails 1014.

As described above, to form top 204, minor flap 50 and 110 are folded inward. Accordingly, as container 200 passes through forming section 1004, a central stationary plow 1050 folds leading minor flap 50 inward, and a swinging arm 1052 folds trailing minor flap 110 inward. More specifically, central stationary plow 1050 includes an arcuate portion 1054 that folds leading minor flap 50 when leading minor flap 50 contacts central stationary plow 1050.

The swinging arm 1052 includes a curved member 1056 and a contact bar 1058. The swinging arm 1052 is rotatably coupled to a shaft 1060. To fold trailing minor flap 110, the swinging arm 1052 is rotated about the shaft 1060 between a raised position and a lowered position using, for example, the control unit 1030. The swinging arm 1052 is shown in the raised position in FIGS. 11-15, and shown in the lowered position in FIG. 19. As the swinging arm 1052 is rotated about the shaft 1060 from the raised position to the lowered position, the contact bar 1058 contacts and folds inward trailing minor flap 110. To enable the machine 1000 to fold minor flap 50 and 110 without interference from major flaps 90 and 130, a pair of stationary spreader bars 1070 spread the major flaps 90 and 130 apart from each other.

In the exemplary embodiment, immediately after minor flaps 50 and 110 are folded, an adhesive, such as glue, is applied to major flaps 90 and 130. The adhesive may be applied using one or more glue nozzles. Notably, immediately after minor flaps 50 and 110 are folded, centering tabs 52 and 112 and major flaps 90 and 130 remain unfolded (i.e., substantially upright).

As described above, to form top 204, major flaps 90 and 130 are folded inward after minor flaps 50 and 110 have been folded. Accordingly, as container 200 passes through forming section 1004, a pair of stationary side plows 1080 fold major flaps 90 and 130 inward. In the exemplary embodiment, each stationary side plow 1080 is a rod that extends inward and downward while still substantially extending along loading direction X. The forming station also includes a central stationary plate 1090 that facilitates keeping container 200 aligned as major flaps 90 and 130 are folded. Specifically, as major flaps 90 and 130 are folded inward, a top edge of each flap contacts a respective side of central stationary plate 1090, maintaining alignment of container 200.

In the exemplary embodiment, immediately after major flaps 90 and 130 are folded, an adhesive, such as glue, is applied to major flaps 90 and 130. The adhesive may be applied using one or more glue nozzles. Notably, immediately after major flaps 90 and 130, centering tabs 52 remain unfolded (i.e., substantially upright).

As described above, to form top 204, centering tabs 52 and 112 are folded inward after major flaps 90 and 130 have been folded. Accordingly, as container 200 passes through forming section 1004, a bullet arm 1100 strikes and folds inward trailing centering tab 112. In the exemplary embodiment, the machine 1000 includes two bullet arms 1100 for folding inward two respective trailing centering tabs (e.g., for container 500).

Figure 16:
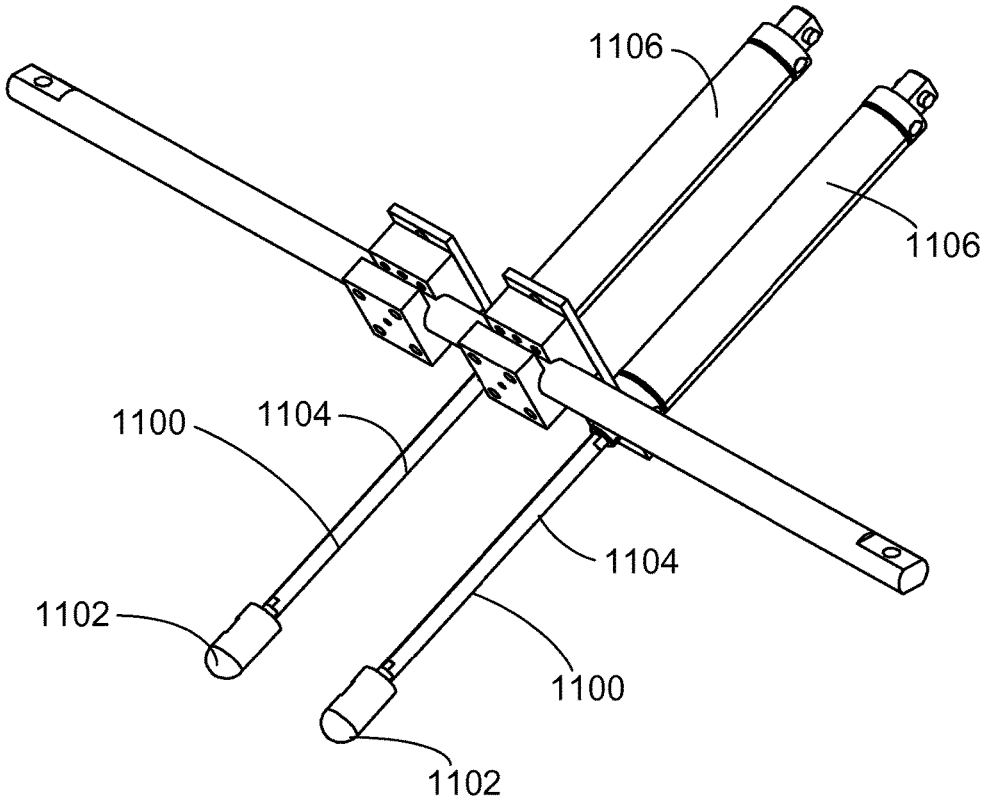
FIG. 16 is a perspective view of bullet arms of the forming section shown in FIG. 11.

FIG. 16 is a perspective view of bullet arms 1100. Each bullet arm 1100 includes a tip 1102, a shaft 1104, and an actuating cylinder 1106. In the exemplary embodiment, actuating cylinders 1106 pneumatically move tip 1102 and shaft 1104 between an unfired position (not shown) and a fired position (shown in FIG. 16). Specifically, in the unfired position, the shaft 1104 is housed within the actuating cylinder 1106, while in the fired position, the shaft 1104 extends from the actuating cylinder 1106.

At a predetermined time (e.g., in response to the container 200 striking a switch 1040), the actuating cylinder 1106 fires and moves the tip 1102 and the shaft 1104 from the unfired position to the fired position. As the tip 1102 moves from the unfired position to the fired position, the tip 1102 strikes trailing centering tab 112 to fold inward trailing centering tab 112.

In the exemplary embodiment, the machine 1000 includes a parallel pair of roller guide members 1110 that extend along the loading direction X. Roller guide members 1110 each include a plurality of rotatable wheels 1112. As container 200 passes through the machine 1000, the rotatable wheels 1112 rotate and contact the side panels 18 and 26 to facilitate moving container 200 though the machine 1000 and maintaining alignment of container 200.

Figure 17:
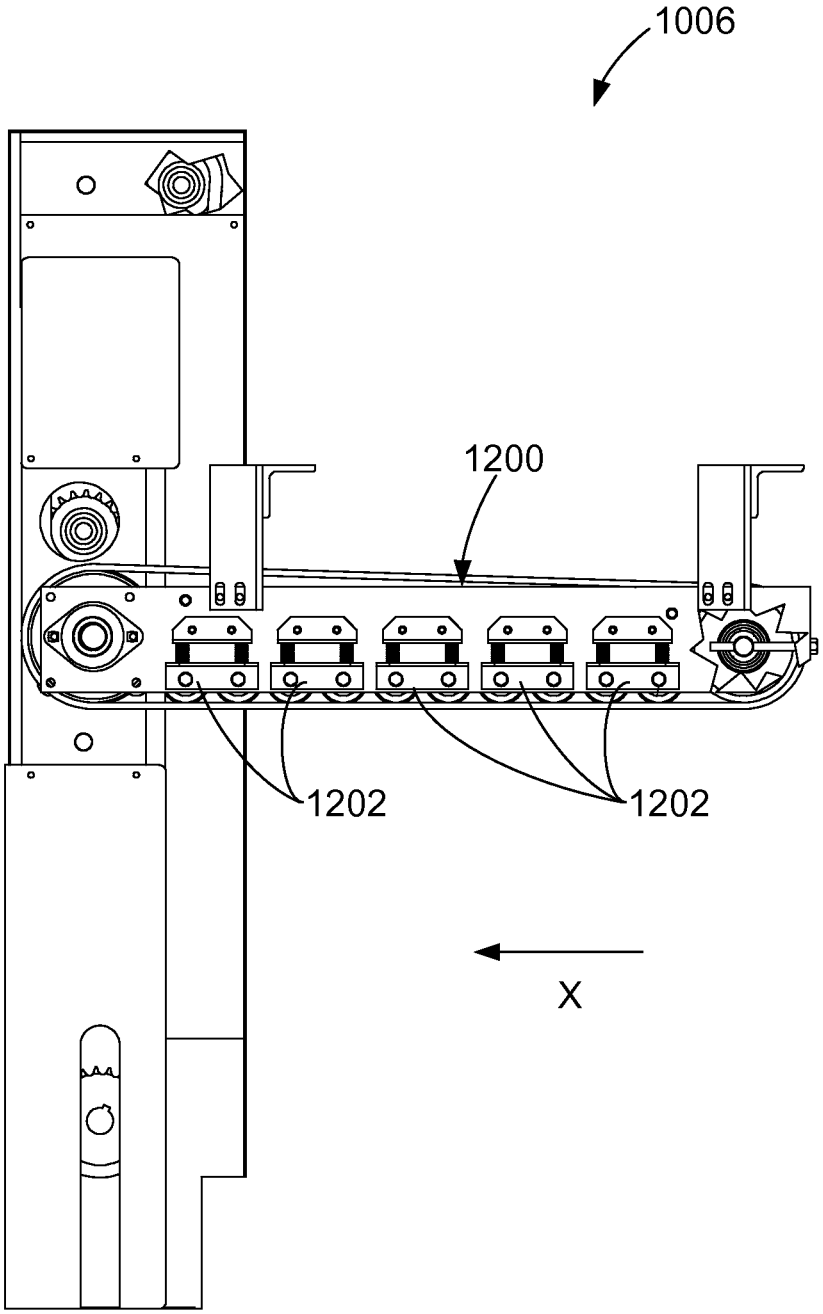
FIG. 17 is a side view of a compression section of the machine shown in FIG. 9.

FIG. 17 is a side view of the compression section 1006. In the exemplary embodiment, the compression section includes a compression conveyor 1200. Compression conveyor 1200 could be any compression device configured to perform as described herein. As container 200 passes from forming section 1004 to compression section 1006, the compression conveyor 1200 folds leading centering tab 52 inward. The compression conveyor 1200 moves at substantially the same speed as the second conveyor 1012 (shown in FIG. 9). The compression conveyor 1200 includes a plurality of biasing members 1202 that bias compression conveyor 1200 downward. In the exemplary embodiment, the biasing members 1202 are spring loaded. Accordingly, as container 200 passes through compression section 1006, the compression conveyor 1200 compresses the formed top 204 of container 200. Compressing the top 204 improves the adhesive bonding between centering tabs 52 and 112, major flaps 90 and 130, and minor flaps 50 and 110. Further, biasing members 1202 enable compression conveyor 1200 to compress tops 204 for containers 200 having a slight variation in height (i.e., containers that are slightly taller and/or shorter than each other). After container 200 exits compression section 1006 on second conveyor 1012, the top 204 of container 200 has been formed and sealed.

Figure 18:
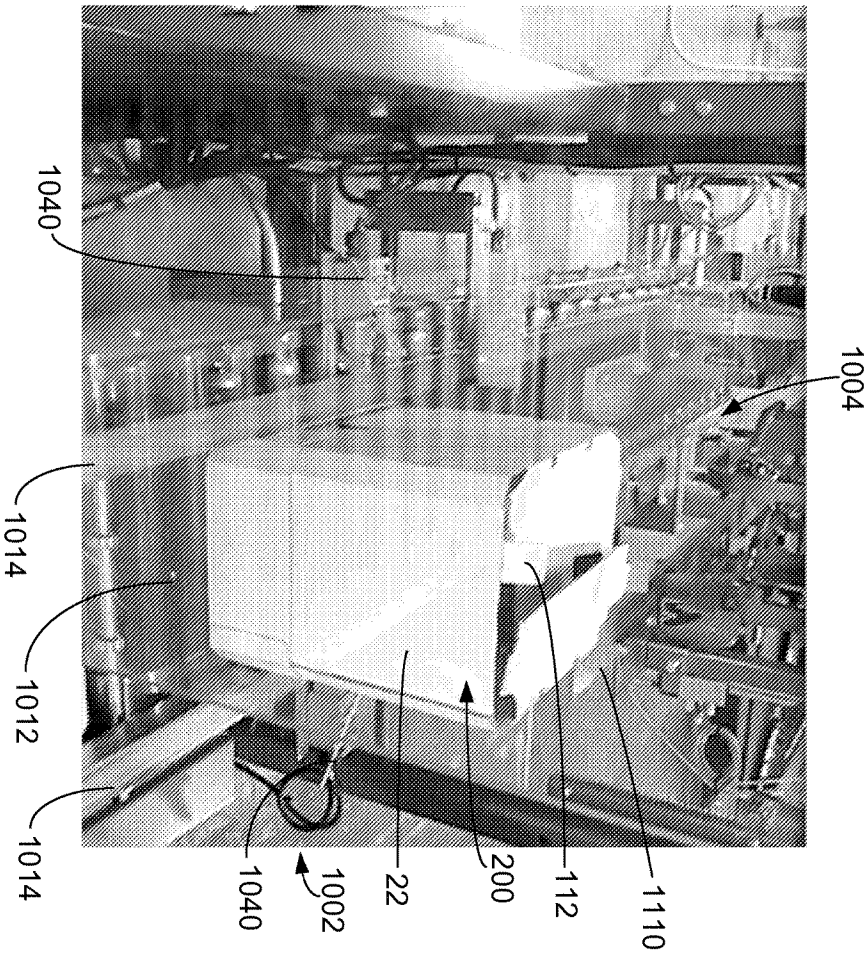
FIG. 18 is a perspective view of a container entering a forming section of the machine shown in FIG. 9.

FIG. 18 is a perspective view of container 200 entering the forming section 1004. Although centering tabs 52 and 112, major flaps 90 and 130, and minor flaps 50 and 110 are shown partially folded, those of ordinary skill will appreciate that centering tabs 52 and 112, major flaps 90 and 130, and minor flaps 50 and 110 would still be upright at this stage.

Figure 19:
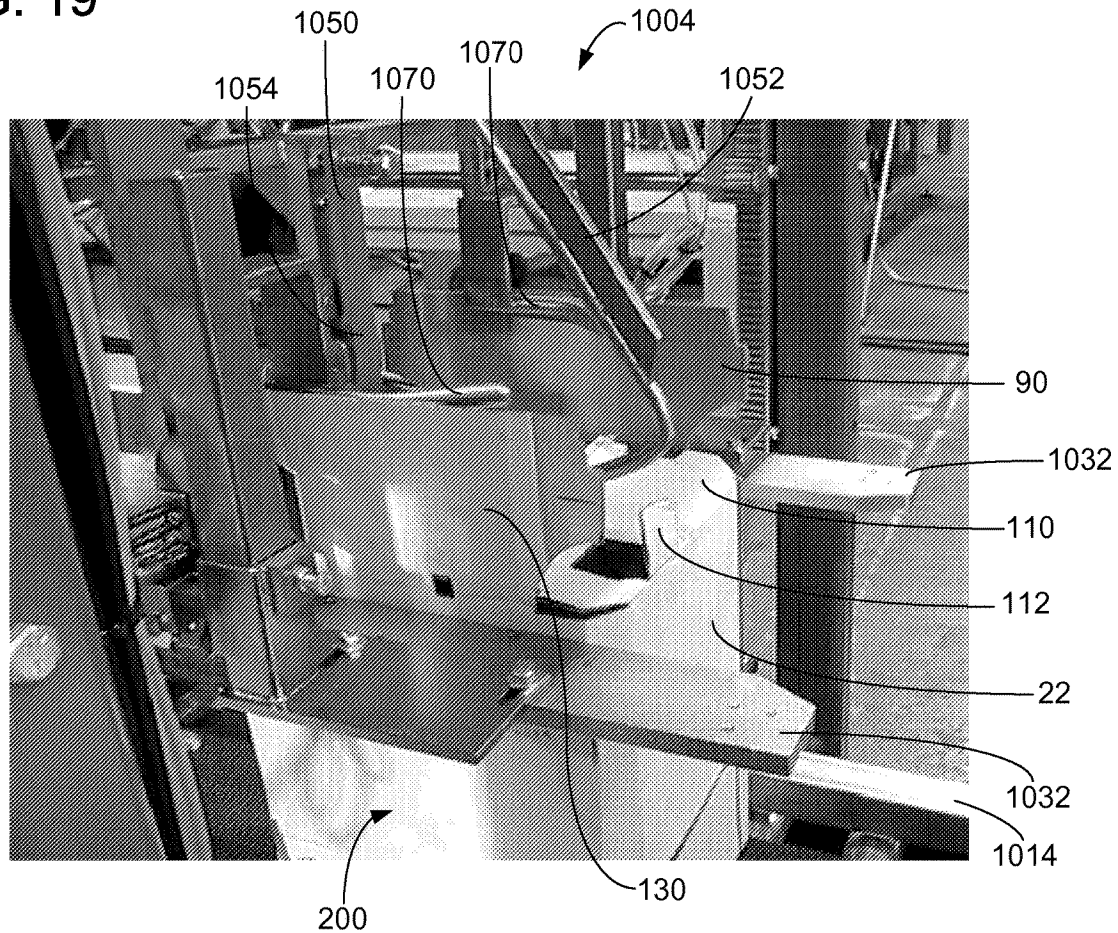
FIG. 19 is a perspective view of a container in a forming section of the machine shown in FIG. 9.

FIG. 19 is a perspective view of container 200 in the forming section 1004. As shown in FIG. 19, the swinging arm 1052 is in the lowered position to fold inward trailing minor flap 110. Further, FIG. 19 illustrates the spreader bars 1070 spreading major flaps 90 and 130.

Figure 20:
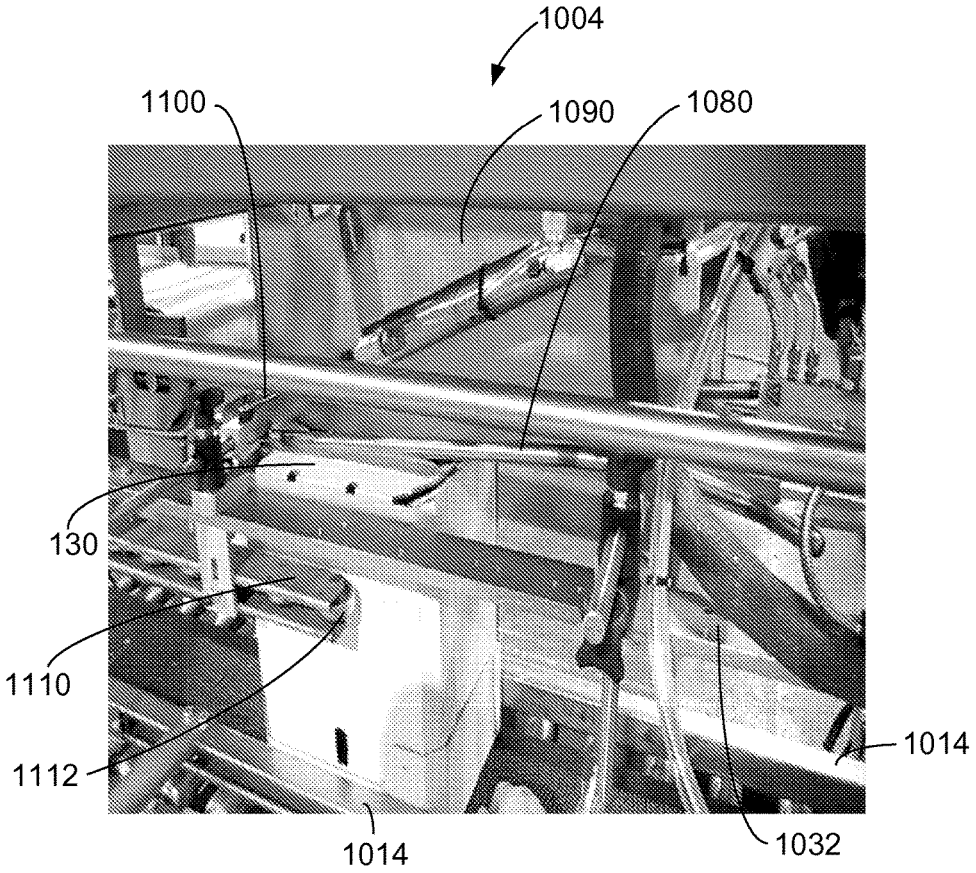
FIG. 20 is a perspective view of a container in a forming section before entering a compression section of the machine shown in FIG. 9.

FIG. 20 is a perspective view of container 200 in forming section 1004 before entering compression section 1006. In FIG. 20, major flaps 90 and 130 have been folded inward by stationary side plows 1080.

Figure 21:
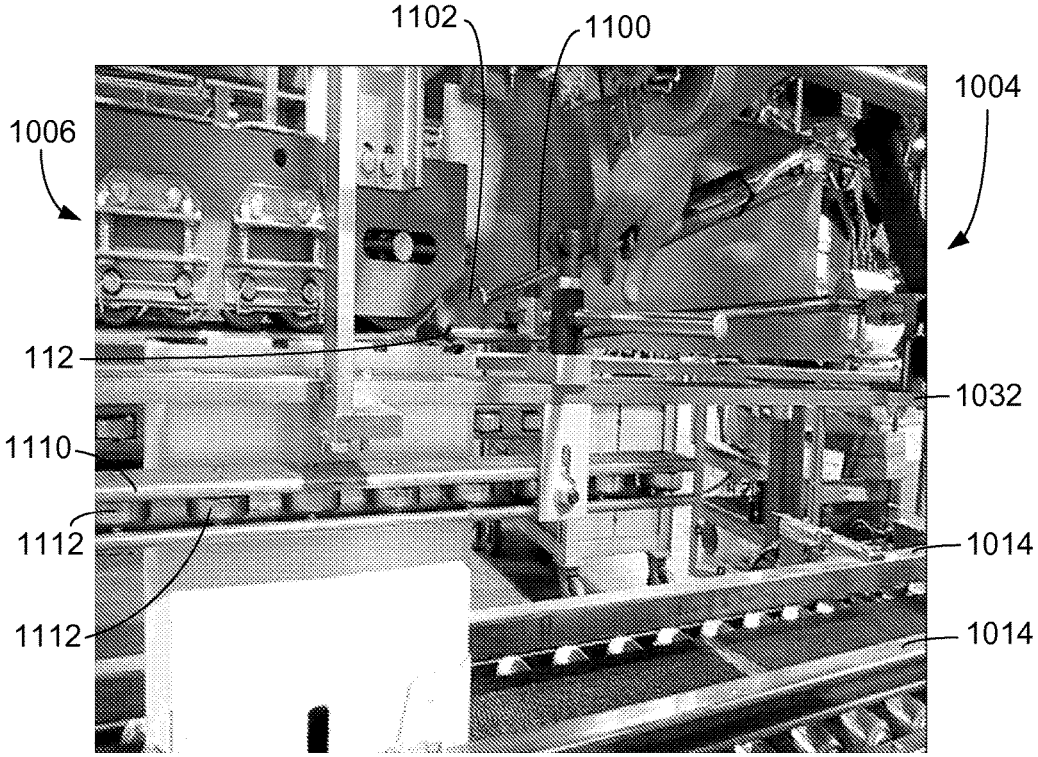
FIG. 21 is a perspective view of a container entering a compression section of the machine shown in FIG. 9.
Figure 22:
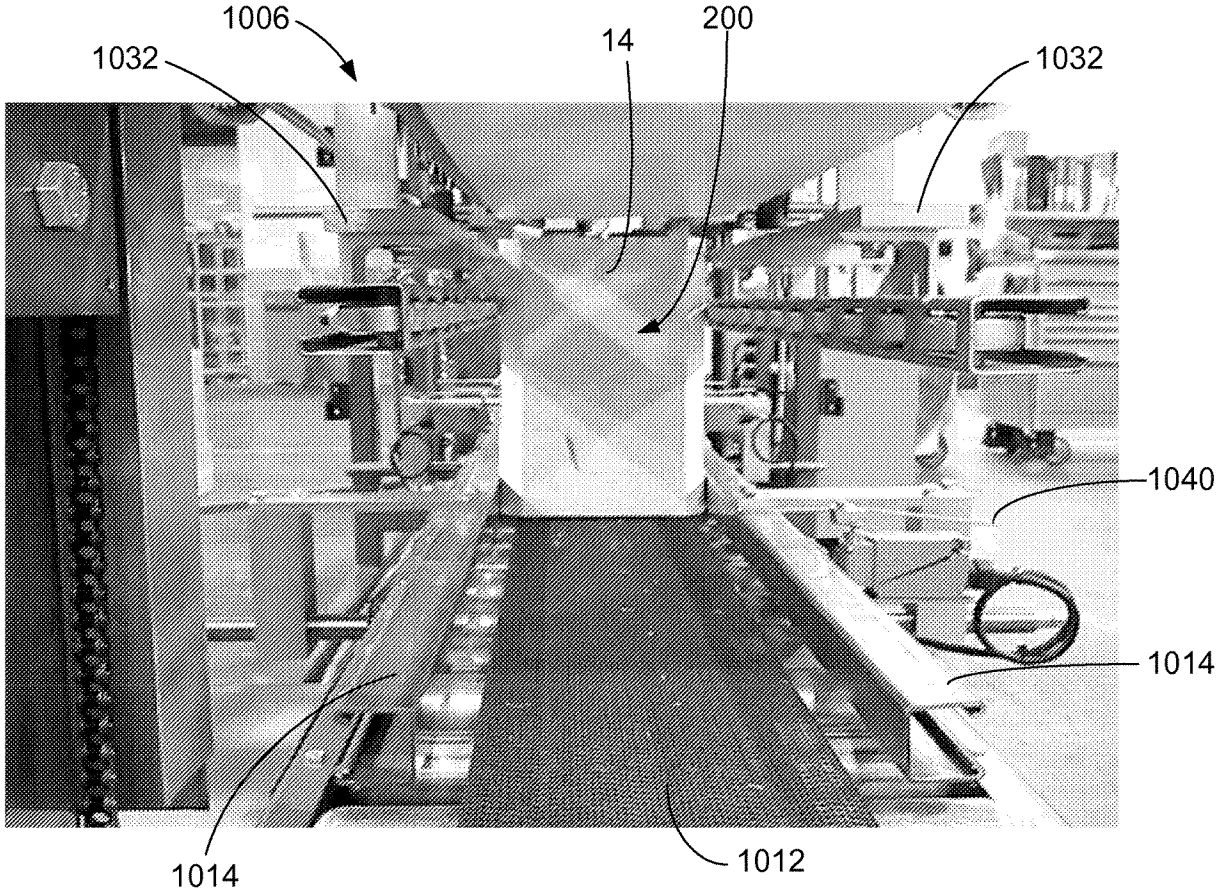
FIG. 22 is a perspective view of a container in a compression section of the machine shown in FIG. 9.

FIG. 21 is a perspective view of container 200 entering compression section 1006. In FIG. 21, tip 1102 of bullet arm 1100 is contacting and folding trailing centering tab 112. FIG. 22 is a perspective view of container 200 in compression section 1006.

Exemplary embodiments of containers including centering tabs, blanks, and machines for making the same are described above in detail. The containers, blanks, and machines are not limited to the specific embodiments described herein, but rather, components of the blanks, containers, and/or machines may be utilized independently and separately from other components and/or steps described herein.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A machine for forming and sealing a top of a container, the container comprising a leading centering tab and a trailing centering tab that are folded into face-contacting relationship with said top, said leading centering tab and said trailing centering tab being positionable within notches formed in a bottom of a second container for facilitating alignment of a plurality of containers, said machine comprising:

a forming section comprising at least one bullet arm, the at least one bullet arm comprising a tip, a shaft, and an actuating cylinder, wherein the actuating cylinder moves the tip and the shaft between a retracted position and an extended position, wherein the shaft is housed within the actuating cylinder when in the retracted position, wherein the tip and shaft are moved from the retracted position to the extended position, the tip strikes the trailing centering tab of the container and folds it into face-contacting relationship with the top; and a compression section downstream from said forming section and comprising a compression device that folds the leading centering tab of the container into face-contacting relationship with the top.

2. A machine in accordance with claim 1, wherein said compression device compresses a formed top of the container to seal the formed top of the container.

3. A machine in accordance with claim 1, wherein said compression device comprises: a compression conveyor; and a plurality of biasing members that bias said compression conveyor downward against the formed top of the container.

4. A machine in accordance with claim 1, wherein said forming section further comprises a central stationary plow that folds a leading minor flap of the container.

5. A machine in accordance with claim 1, wherein said forming section further comprises a swing arm that folds a trailing minor flap of the container.

6. A machine in accordance with claim 5, wherein said forming section further comprises stationary spreader bars that spread a first major flap and a second major flap of the container apart from each other while said swing arm folds the trailing minor flap.

7. A machine in accordance with claim 6, wherein said forming section further comprises stationary side plows that fold the first major flap and the second major flap.

8. A machine in accordance with claim 5, wherein said swing arm comprises a curved member and a contact bar.

9. A machine in accordance with claim 1, wherein said forming section further comprises a central stationary plate that maintains alignment of the container as the container passes through said forming section.

10. A machine in accordance with claim 1, further comprising an actuating cylinder that moves said shaft between the retracted position and the extended position.

* * * * *